US005733156A

United States Patent [19]

Aihara et al.

[11] Patent Number: 5,733,156

[45] Date of Patent: Mar. 31, 1998

[54] VARIABLE PROPELLER FOR BOAT

[75] Inventors: Takao Aihara; Hideaki Takada; Ikuo Nakazato, all of Wako, Japan

[73] Assignee: Honda Giken Kogyo Kabushiki Kaisha, Tokyo, Japan

[21] Appl. No.: 576,038

[22] Filed: Dec. 21, 1995

[30] Foreign Application Priority Data

Dec. 21, 1994 [JP] Japan ..... 6-318539

[51] Int. Cl.[6] ..... B63H 1/14

[52] U.S. Cl. ..... 440/49; 416/147

[58] Field of Search ..... 440/50, 49, 76, 440/77, 78, 79, 83; 416/163, 167, 147

[56] References Cited

U.S. PATENT DOCUMENTS 3,082,827 3/1963 Rosen ..... 440/50

3,565,544 2/1971 Marshall .

5,073,134 12/1991 Muller et al. ..... 440/50

*Primary Examiner*—Stephen Avila

*Attorney, Agent, or Firm*—Nikaido, Marmelstein, Murray & Oram LLP

[57] ABSTRACT

In a variable propeller for a boat, variable-diameter main blades and stationary subsidiary blades are mounted on a propeller boss in order to provide further enhanced low-speed driving property and high-speed and high-output performance. When the main blades are in closed positions in which the propeller diameter assumes a minimum value, the main and subsidiary blades are axially superposed on each other. When the main blades are in opened positions in which the propeller diameter assumes a maximum value, the main and subsidiary blades are arranged in a relation such that their blade surfaces are substantially in line with each other.

7 Claims, 10 Drawing Sheets

VARIABLE PROPELLER FOR BOAT

BACKGROUND OF THE INVENTION

1. Field of the Invention

The present invention relates to a variable propeller for a boat, in which the propeller diameter can be adjusted in correspondence to a rotational speed of the propeller to satisfy a low-speed driving property and a high-speed and high-output performance.

2. Description of the Relevant Prior Art

Such a variable propeller is already known, for example, as disclosed in U.S. Pat. No. 3,565,544.

In the variable propeller disclosed in the above patent, all blades are supported on propeller bosses by pins to adjust the propeller diameter. In the propeller of such a construction, however, unless the amount of variation in propeller diameter, i.e., the blade opening or closing angle is increased, there is a limit on an increase in the range of variation in thrust force and hence, it is difficult to further enhance the low-speed driving property or the high-speed and high-output performance.

SUMMARY OF THE INVENTION

Accordingly, it is an object of the present invention to provide a variable propeller for a boat, wherein the range of variation in thrust force can be widened within a limited range of amount of variation in propeller diameter to enhance the low-speed driving property and the high-speed and high-output performance.

To achieve the above object, according to the present invention, there is provided a variable propeller for a boat, comprising: a propeller boss connected to a propeller shaft; a main blade pivotally carried on the propeller boss through a blade shaft for opening and closing movements to increase and decrease a propeller diameter; and a subsidiary blade which is fixedly mounted on the propeller boss and arranged abreast with the main blade such that the subsidiary blade is axially superposed on the main blades when the main blade is in a closed state in which the propeller diameter assumes a minimum value, and blades surfaces of the main and subsidiary blades are substantially in line with each other when the main blade is in an opened state in which the propeller diameter assumes a maximum value.

With the above feature of the present invention, in a low-speed rotational range of the propeller, the total thrust force of the main and subsidiary blades is substantially reduced to provide an enhanced low-speed driving property by the facts that the propeller diameter provided by the main blades assumes the minimum value and that the main and subsidiary blades are superposed on each other in the axial direction of the propeller boss to interfere with a water flow generated by the mating blades. In a high-speed rotational range of the propeller shaft, the total thrust force of the main and subsidiary blades can be effectively increased to provide an enhanced high-speed and high-output performance by the facts that the propeller diameter provided by the main blades assumes the maximum value and that the main and subsidiary blades cooperate in increase the blade area.

The above and other objects, features and advantages of the invention will become apparent from the following description of preferred embodiments taken in conjunction with the accompanying drawings.

DESCRIPTION OF THE PREFERRED EMBODIMENTS

Figure 1:
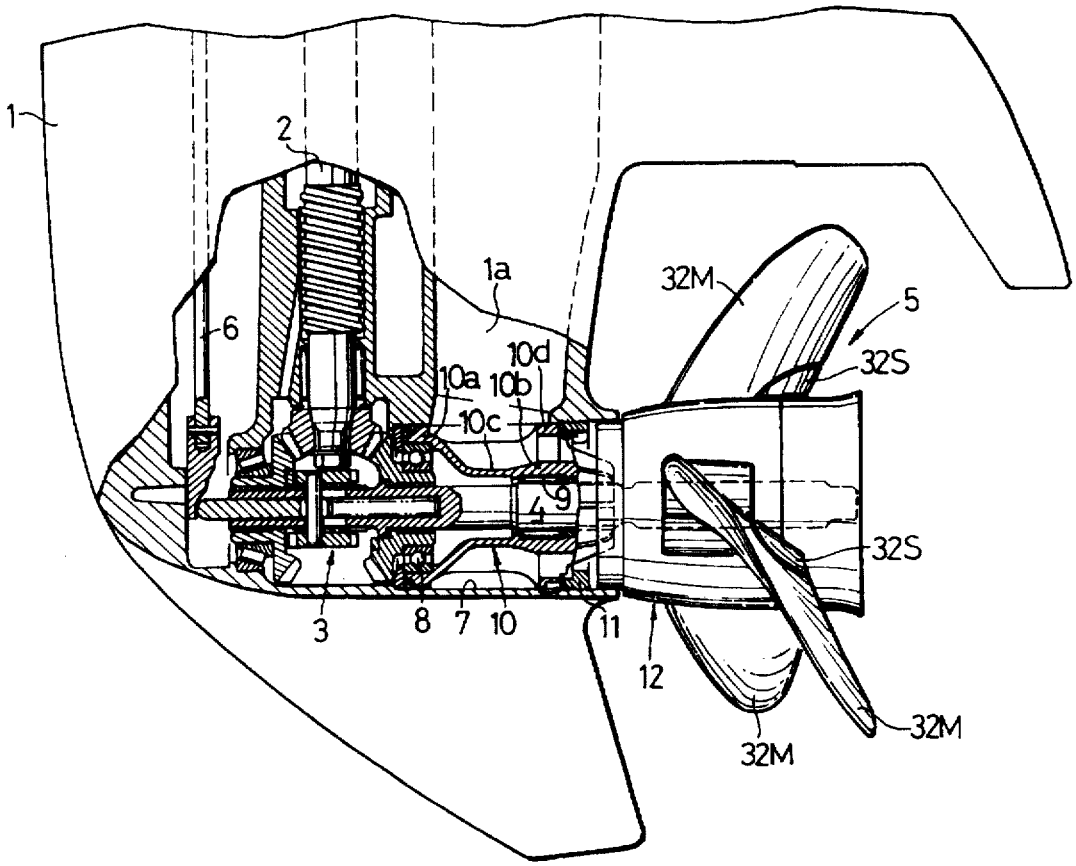
FIG. 1 is a partially vertical sectional side view of an essential portion of an outboard engine equipped with a propeller according to a first embodiment of the present invention.

A first embodiment of the present invention will now be described with reference to FIGS. 1 to 9. Referring to FIG. 1, a vertically disposed driving shaft 2 and a horizontally disposed propeller shaft 4 are carried in a propelling machine body 1 of an outboard engine which is attached to a transom of a boat. The driving shaft 2 is driven from an engine which is not shown, and the propeller shaft 4 is connected to the driving shaft 2 through a forward and backward gear mechanism 3. A variable propeller 5 is mounted to that portion of the propeller shaft 4 which protrudes rearwardly from the machine body 1.

The forward and backward gear mechanism 3 is of a known bevel gear type and is switchable between a forward mode capable of driving the propeller shaft 4 through the driving shaft 2 in a forward direction, and a backward mode capable of driving the propeller shaft 4 through the driving shaft 2 in a backward direction by lifting and lowering of a switching rod 6 parallel to the driving shaft 2.

Figure 2:
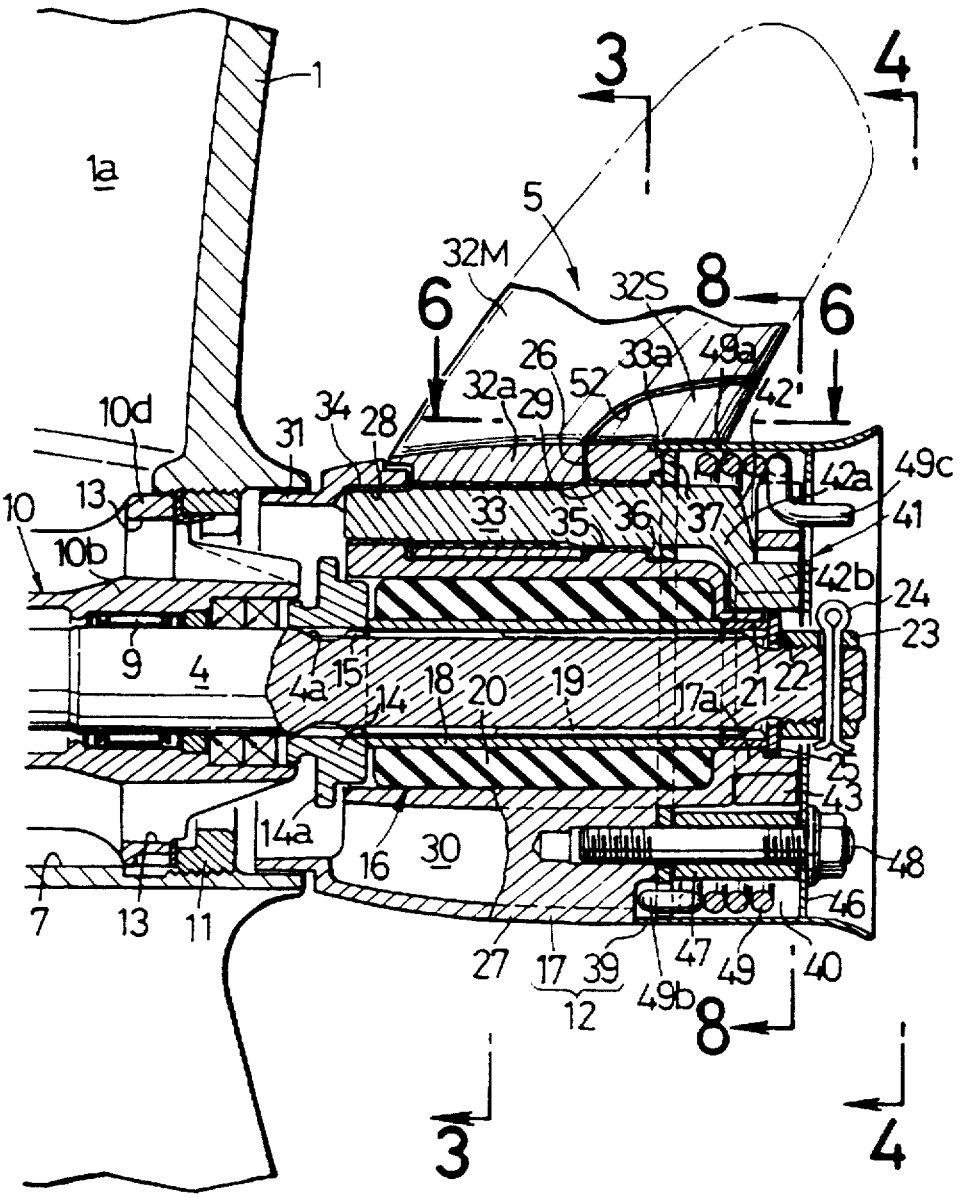
FIG. 2 is an enlarged vertical sectional view of a propeller section shown in FIG. 1.

Referring to FIGS. 1 and 2, a bearing holder 10 for retaining a pair of front and rear bearings 8 and 9 for supporting the propeller shaft 4 is fitted into a mounting bore 7 which opens into a rear surface of the machine body 1. A ring nut 11 is threadedly mounted in the mounting bore 7 for retaining the bearing holder 10 from the rear. The bearing holder 10 includes a large-diameter cylindrical portion 10*a* for retaining the front ball bearing 8, and a small-diameter cylindrical portion 10*b* for retaining the rear needle bearing 9. The cylindrical portions 10*a* and 10*b* are integrally interconnected through a tapered cylindrical portion 10*c*. The small-diameter cylindrical portion 10*b* is integrally formed with a flange 10*d* which protrudes from an outer peripheral surface of the small-diameter cylindrical portion 10*b* and which is retained by the ring nut 11. The flange 10*d* is provided with a plurality of exhaust gas outlets 13 which communicate with an exhaust port in the engine through a hollow 1*a* in the machine body 1.

The construction of the variable propeller 5 will be described with reference to FIGS. 2 to 9.

Referring to FIG. 2, a thrust ring 14 is fitted over the propeller shaft 4 through a spline 15 adjacent a rear end of the bearing holder 10. The thrust ring 14 abuts against a tapered surface 4a of the propeller shaft 4, so that the forward movement thereof is inhibited.

A boss body 17 of a propeller boss 12 is connected to the propeller shaft 4 through a torque limiting device 16 at the rear of the thrust ring 14. The torque limiting device 16 and the boss body 17 are disposed so that they are superposed concentrically about the propeller shaft 4.

The torque limiting device 16 includes a sleeve 18 which is detachably fitted over the propeller shaft 4 through a spline 19, and a rubber damper 20 which is baked to an outer peripheral surface of the sleeve 18 and press-fitted to an inner peripheral surface of the boss body 17. The rubber damper 20 is connected to the boss body 17 with a predetermined frictional force, so that when the rubber damper 20 undergoes a rotative torque having a predetermined value or more, a slipping is produced between the rubber damper 20 and the boss body 17.

An extended collar 21 is spline-fitted over the propeller shaft 4 and abuts against a rear end of the sleeve 18. A nut 23 is threadedly mounted at a rear end of the propeller shaft 4 to retain a rear end of the extended collar 21 through a thrust washer 22 having a diameter larger than that of the extended collar 21. A locking split pin 24 is inserted into the nut 23 and the propeller shaft 4. The extended collar 21 may be integral with the sleeve 18.

The boss body 17 includes a positioning boss 17a which protrudes rearwardly from an end wall covering a rear end of the rubber damper 20 and which is rotatably fitted over the extended collar 21, thereby maintaining the concentric position of the boss body 17 relative to the propeller shaft 4. The positioning boss 17a is formed into a cylindrical shaft to surround the thrust washer 22 and is provided, on its inner peripheral surface, with a shoulder 25 which is opposed to a front surface of the thrust washer 22, so that a rearward thrust applied to the boss body 17 is received by the thrust washer 22 through the shoulder 25. In this case, a flange may be formed around an outer periphery of the extended collar 21 at its rear end to abut against the shoulder 25.

The boss body 17 has a front end face which is opposed to the flange 14a formed around an outer periphery of the thrust ring 14, so that the flange 14a receives a forward thrust applied to the boss body 17.

Figure 3:
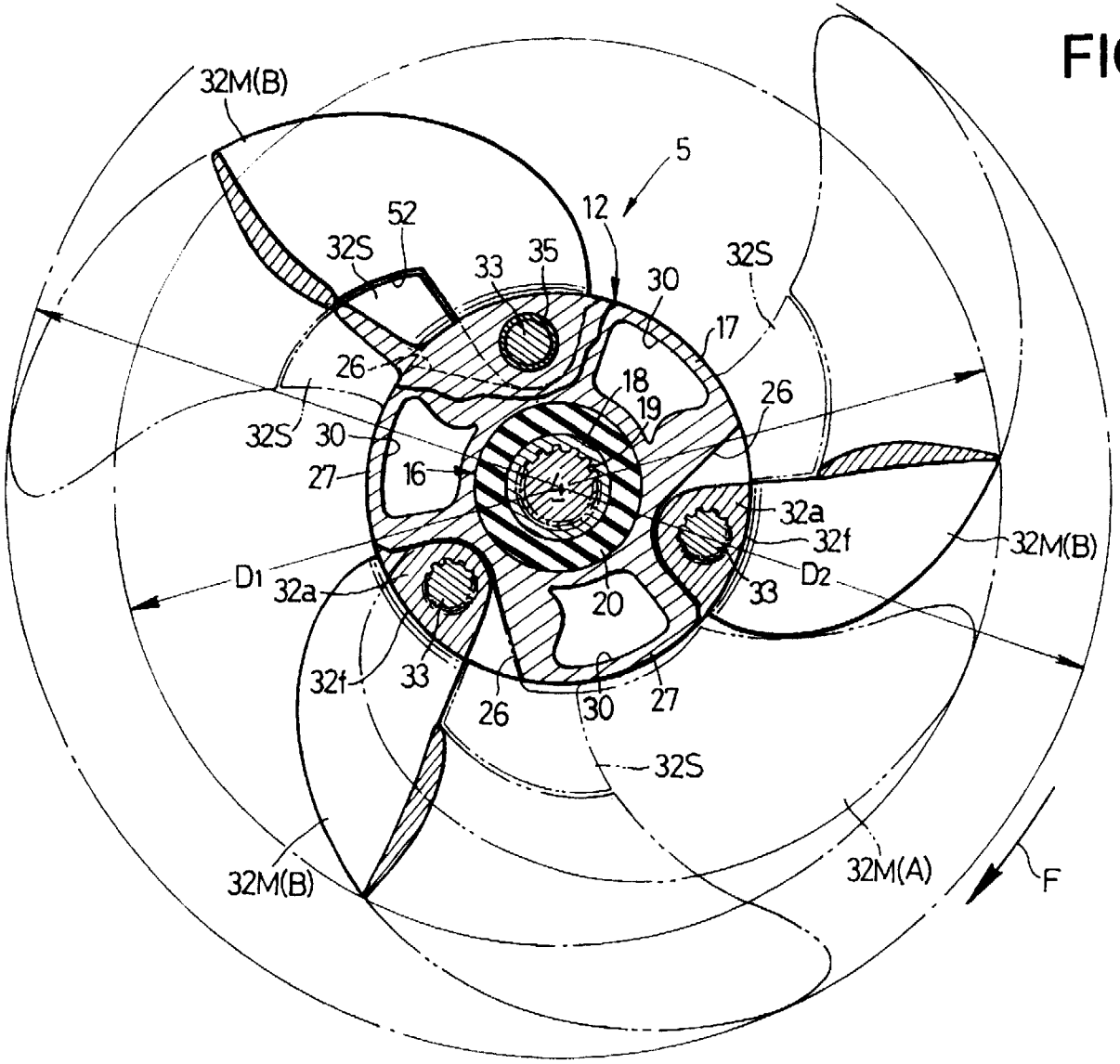
FIG. 3 is a sectional view taken along a line 3—3 in FIG. 2.

Referring to FIGS. 2 and 3, the boss body 17 includes three recesses 26 which open into an outer peripheral surface of the boss body 17 and which are arranged at circumferentially equal distances with their bottom surfaces being located adjacent an outer peripheral surface of the rubber damper 20, a pair of bearing holes 28 and 29 which open into a longitudinally opposite end walls of each of the recesses 26, three exhaust passages 30 each axially extending through a land portion 27 sandwiched between the adjacent recesses 26, and a cylindrical portion 31 which permits the communication between the exhaust passages 30 and the exhaust gas outlets 13. The cylindrical portion 31 is rotatably inserted into a rear opening of the mounting bore 7.

A boss 32a of each of main blades 32M is accommodated in each of the recesses 26 of the boss body 17. Blade shafts 33 are spline-fitted into the bosses 32a and each rotatably carried at its longitudinally opposite ends in the bearing bores 28 and 29, with bushes 34 and 35 made of a synthetic resin being interposed between the blade shaft 33 and the bearing bores 28 and 29, respectively. In this manner, the three blade shafts 33 are disposed in parallel to the propeller shaft 4 to surround the propeller shaft 4.

Each of the blade shafts 33 is provided with a flange 33a which is rotatably accommodated in a circular recess 36 which is formed in a rear opening of the rear bearing bore 29. A common retaining plate 37 for retaining the flange 33a from the rear to fix the axial positions of the blade shafts 33 is secured to a rear end face of the boss body 17 by a bolt 38 which will be described hereinafter. The retaining plate 37 is provided with an exhaust bore 30a which is aligned with the exhaust passages 30.

As shown in FIG. 3, each of the main blades 32M is turned along with the blade shaft 33 between a closed position A in which the propeller diameter is of a minimum value $D_1$, and an opened position B in which the propeller diameter is of a maximum value $D_2$. The closed and opened positions A and B are defined by abutment of the boss 32a against an inner wall of the recess 26. The main blade 32M is formed around its outer periphery with an arcuate surface 32f which is in line with an outer peripheral surface of the boss body 17, when the main blade 32M is in the opened position B.

Figure 6:
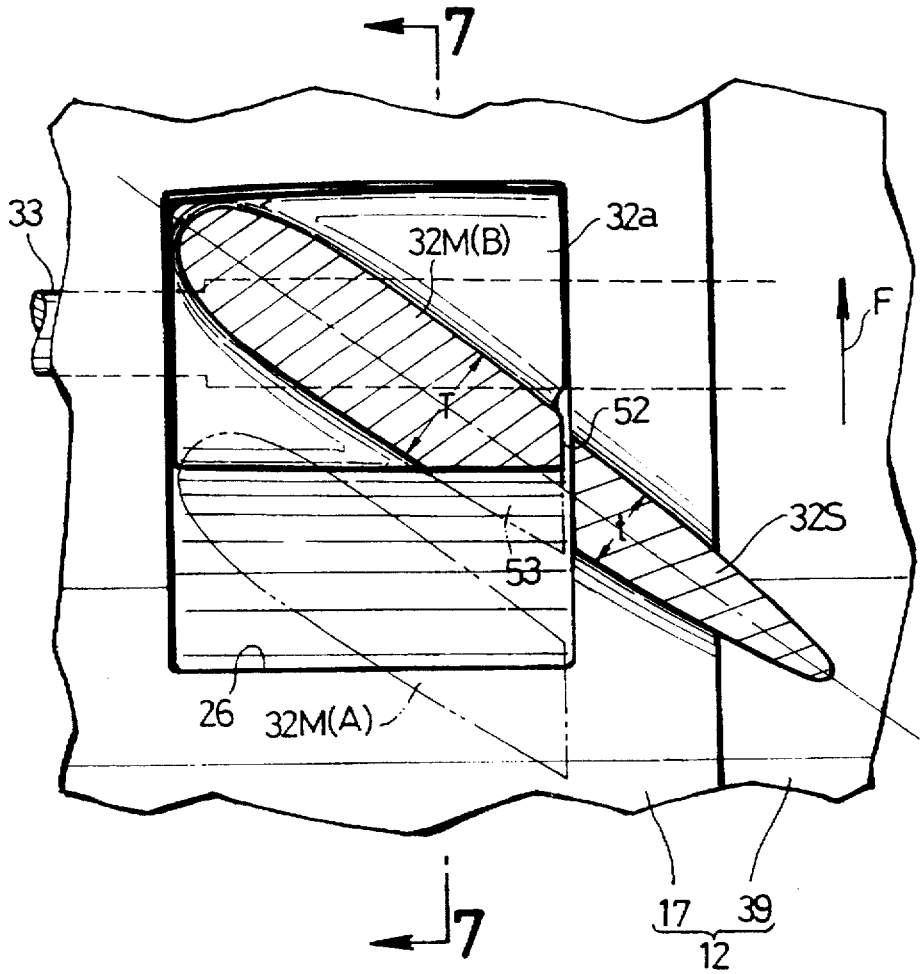
FIG. 6 is an enlarged sectional view taken along a line 6—6 in FIG. 2.
Figure 7:
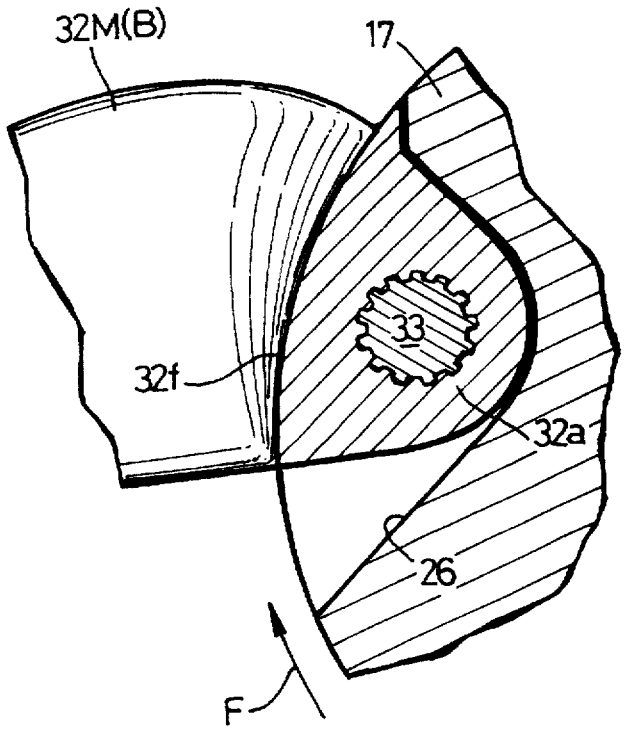
FIG. 7 is a sectional view taken along a line 7—7 in FIG. 6.

As shown in FIGS. 2, 3 and 6, a rear edge of the main blade 32M protrudes rearwardly from a rear end of the boss 32a, and has a notch 52 provided at its radially inner end. A subsidiary blade 32S is integrally formed on the outer peripheral surface of the boss body 17, so that it is aligned with the notch 52 when the main blade 32M is in the opened position B. When the subsidiary blade 32S is aligned with the notch 52, a blade surface thereof is substantially in line with a blade surface of the main blade 32M. However, in fact, the thickness t of the subsidiary blade 32S is set at a value slightly smaller than the thickness T of the main blade 32M. Thus, even if the centers of the blades 32M and 32S are misaligned from each other to some extent due to a manufacture error, it can be avoided that the subsidiary blade 32S is out of line with the blade surface of the main blade 32M to disturb a water flow. The rounding of the a corner at a front end of the subsidiary blade 32S is an effective approach for preventing the disturbance of the water flow due to the manufacture error. Further, the main blade 32M is provided at its base rear edge with a relief 53 (see FIG. 6) for avoiding an interference with an inner surface of the recess 26 at the closed position of the main blade 32M.

Figure 4:
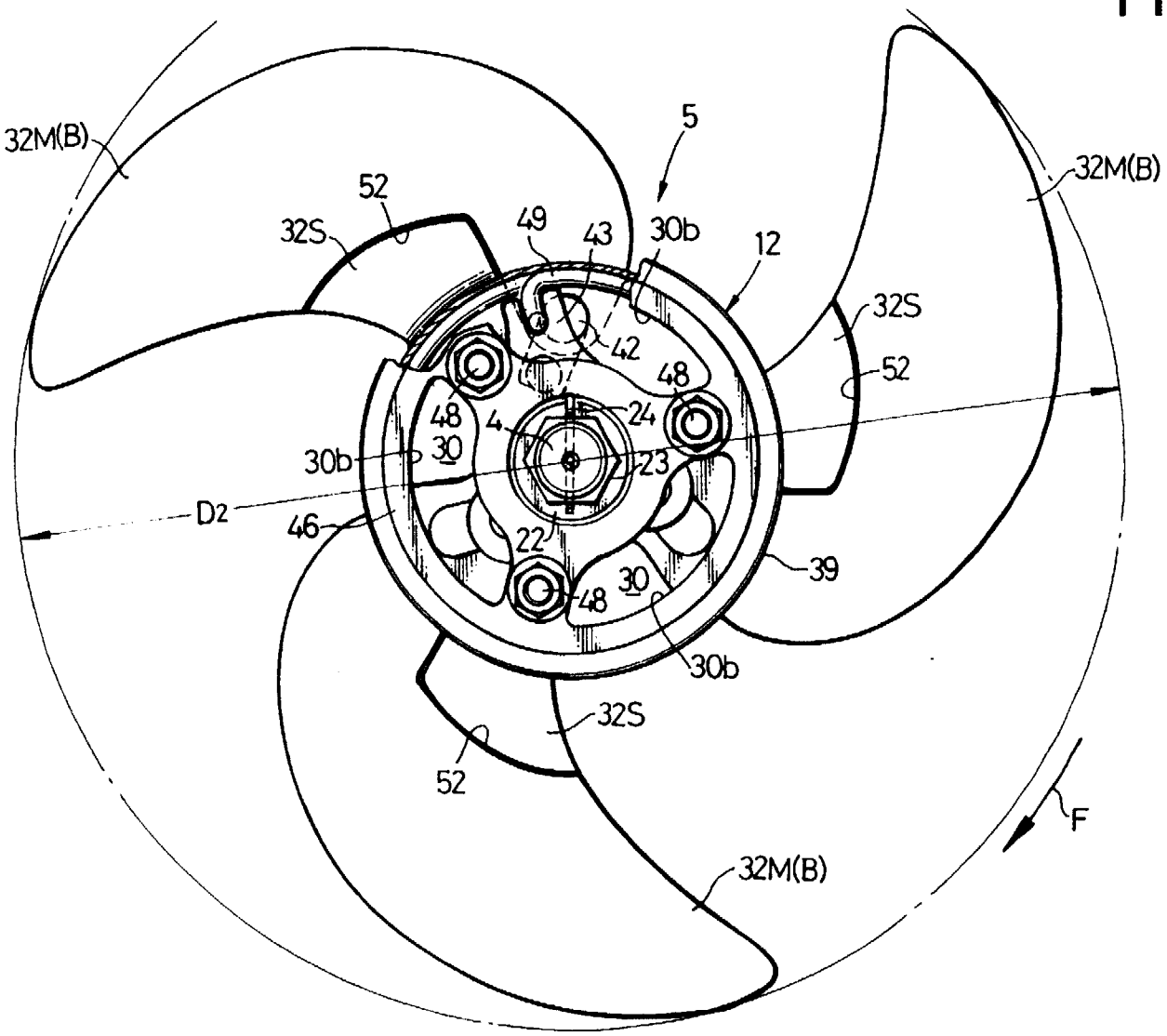
FIG. 4 is a front view taken along a line 4—4 in FIG. 2 and illustrating opened states of main blades.
Figure 10:
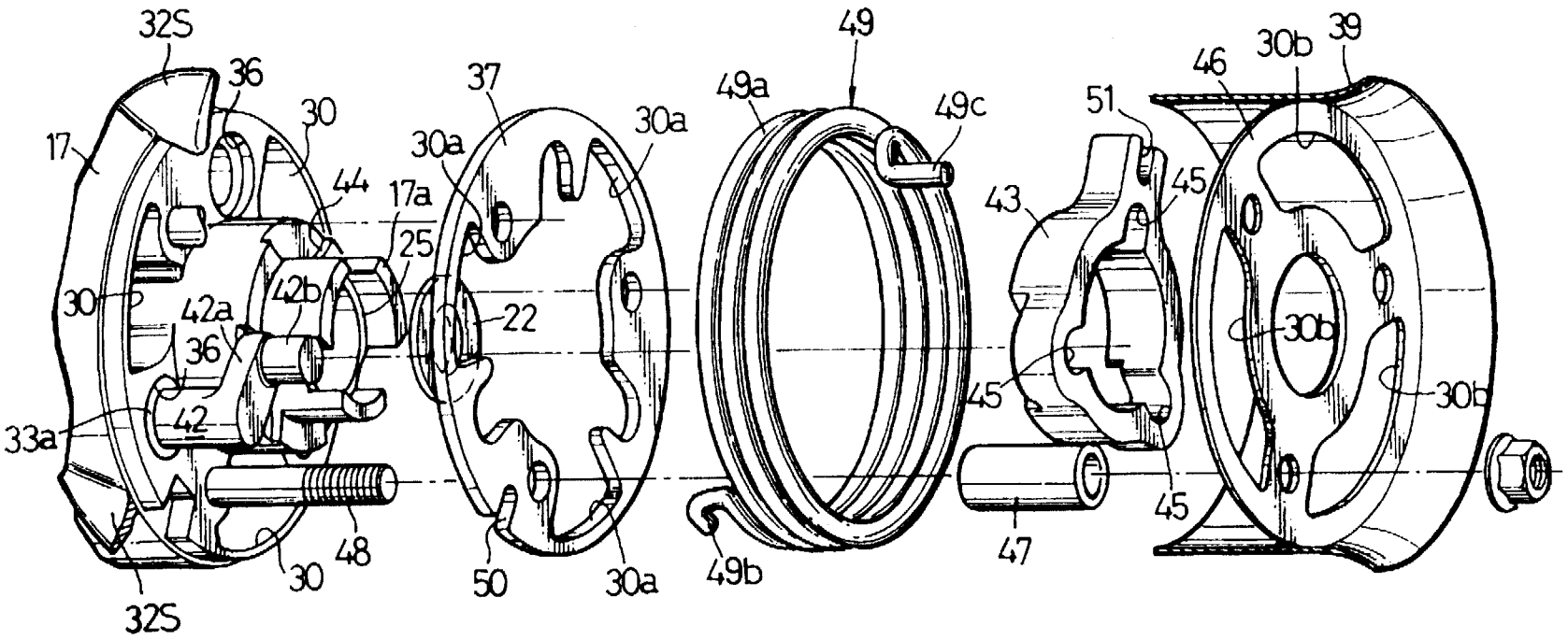
FIG. 10 is an exploded perspective view of an essential portion of the propeller.

As shown in FIGS. 2, 4 and 10, the propeller boss 12 includes a thin diffuser pipe 39 which is fitted to the rear end of the boss body 17 so that their outer peripheral surfaces are in line with each other. A mounting plate 46 is welded to an inner peripheral wall of the diffuser pipe 39 and secured to the rear end face of the boss body 17 in such a manner that they sandwich a distance collar 47 and the retaining plate 37 therebetween. Exhaust bores 30b are provided in the mounting plate 46 at locations corresponding to the exhaust gas passages 30. The mounting plate 46 is disposed to define a synchronizing chamber 40 between the mounting plate 46 and the rear end face of the boss body 17, and a synchronizer 41 is formed in the synchronizing chamber 40 for synchronizing all the main blades 32M.

Figure 8:
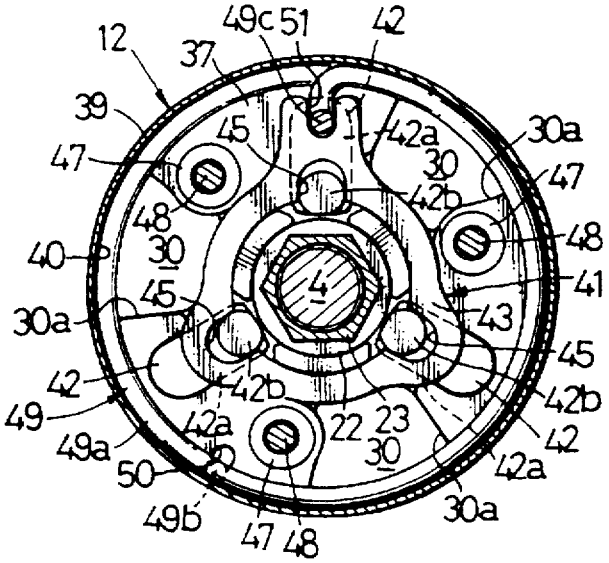
FIG. 8 is a sectional view taken along a line 8—8 in FIG. 2.
Figure 9:
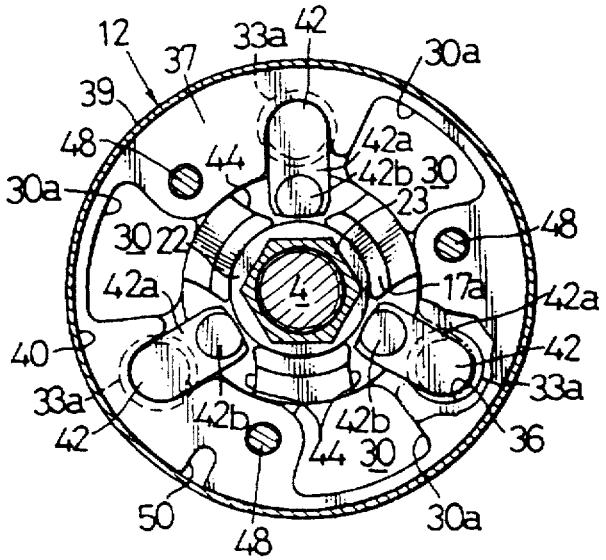
FIG. 9 is a sectional view similar to FIG. 8, with some parts removed.

More specifically, as shown in FIGS. 2, 8 and 10, the synchronizer 41 includes cranks 42 integrally and continuously formed on rear ends of the blade shafts 33, and a single synchronizing ring 43 which is rotatably carried on the outer periphery of the positioning boss 17a. The ring 43 has a rear surface retained by the mounting plate 46 welded to the diffuser pipe 39, so that the separation of the ring 43 from the positioning boss 17a is inhibited.

Each of the cranks 42 has a crank arm 42a which is bent from the blade shaft 33 toward the propeller shaft 4. A crank pin 42b is mounted at a tip end of the crank arm 42a and swingably received in each of arcuate relieves 44 which are formed in the outer periphery of the positioning boss 17*a*. On the other hand, the synchronizing ring 43 is provided with three U-shaped engage grooves 45 which extend radially and open into an inner peripheral surface of the synchronizing ring 43, and the crank pins 42*b* are slidably fitted in the U-shaped engage grooves 45. The synchronizing ring 43 is formed into a substantially triangular contour, so that it does not cover the three exhaust passages 30 from the rear. All the blade shafts 33 can be rotated synchronously with one another by limiting the rotational angles relative to one another through the respective cranks 42 and the common synchronizing ring 43.

A return spring 49 is accommodated in the synchronizing chamber 40 for rotatively biasing all the main blades 32M toward the closed positions through the synchronizer 41. This return spring 49 is formed by a torsion coil spring and has a coiled portion 49*a* which is disposed along an inner peripheral surface of the diffuser pipe 39 to surround all the cranks 42. Locking claws 49*b* and 49*c* are formed at a longitudinally opposite ends of the coiled portion 49*a* to engage locking grooves 50 and 51 which are formed in the retaining plate 37 and the synchronizing ring 43.

The operation of this embodiment will be described below. When the propeller shaft 4 is driven in a forward direction F from the driving shaft 2 through the forward and backward gear mechanism 3, the propeller 5 is driven for rotation by the driving torque from the propeller shaft 4. More specifically, the driving torque from the propeller shaft 4 is transmitted through the sleeve 18 to the propeller boss 12 and hence, the main and subsidiary blades 32M and 32S are rotated along with the propeller boss 12 to generate a forward thrust force.

Figure 5:
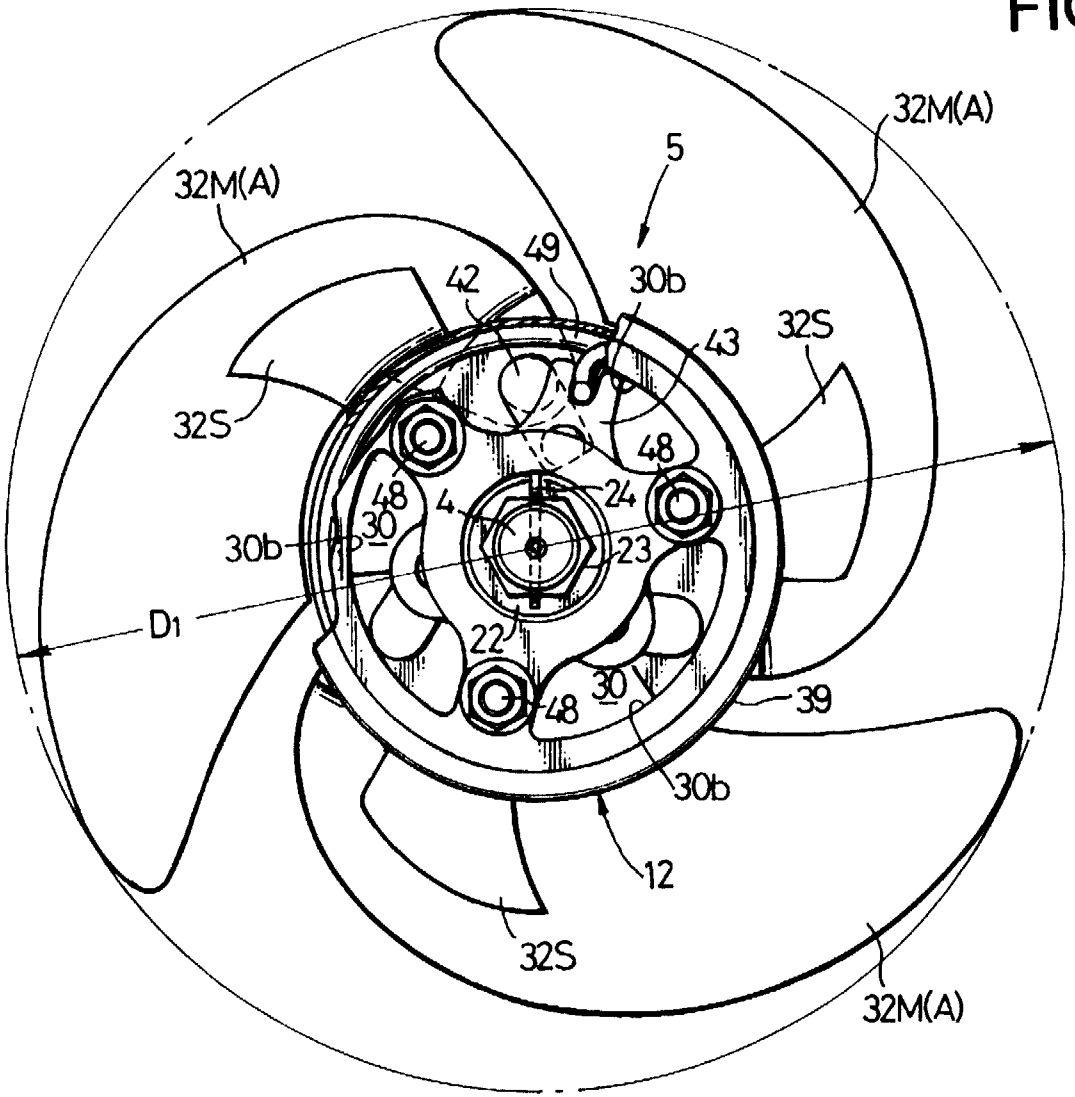
FIG. 5 is a front view similar to FIG. 4, but illustrating closed states of main blades.

In a low-speed rotational range of the propeller 5, the main blades 32M are retained in their closed positions A by a force of the return spring 49 and a drag force of water, so that the propeller diameter is of the minimum value $D_1$, as shown in FIG. 5, and so that the main blades 32H are axially superposed on the subsidiary blades 32S (see a dashed line in FIG. 6). Thus, the total thrust force provided by both the blades 32M and 32S is substantially decreased by the reduction in propeller diameter of the main blades 32M and by the interference of the main and subsidiary blades 32H and 32S with a water flow produced by the mating blades. Therefore, it is possible to achieve a cruising at a super low speed in an idling state of the engine. In addition, because of a slow variation speed of the thrust force generated with a variation in the rotating speed of the propeller 5, the low-speed driving property of the boat can be enhanced to easily effect a trolling, a traveling from and toward the shore and the like.

Thereafter, if the rotating speed of the propeller 5 is increased beyond a given value, the main blades 32M are opened until a centrifugal force acting on the main blades 32M is balanced with the drag force of water and a repulsive force of the return spring 49. If the main blades 32M then enter a predetermined high rotational range, they are turned to their opened closed positions B in which the propeller diameter is of the maximum value $D_2$ and the subsidiary blades 32S are aligned with the notches 52. This causes the total thrust force provided by both of the blades 32M and 32S to be effectively increased by the increase in propeller diameter by the main blades 32M and the enlargement in effective blade surface by the cooperation of the main and subsidiary blades 32M and 32S. Thus, a high-speed and high-output performance is exhibited to enable a high-speed cruising.

When the main blades 32M reach the opened positions B, of each of blades 32M is in line or flush with the outer peripheral surface of the propeller boss 12, and hence, the resistance to the stirring of water by the bosses 32*a* of the main blades 32M is eliminated, which can contribute to an enhancement in high-output performance.

During this time, all the main blades 32M is operatively associated with one another by the synchronizer 41, as described above and therefore, even if there is a variation in external condition to each of the main blades 32H, the variability in their opening angle can be eliminated to always stabilize the performance of the propeller 5.

If a small obstruct such as a floater strikes one of the main blades 32M during navigation, an impact force can be dispersed to all the other main blades 32M through the synchronizer 41, and the rubber damper 20 can be torsionally deformed to moderate the impact force applied to the main blades 32M. If a large obstruct such as rock strikes one of the main blades 32M, a slipping is produced between the rubber damper 20 and the boss body 17*a*, and the propeller shaft 4 is raced relative to the propeller boss 12. Therefore, an over-load to various portions of the propeller 5 as well as to a power transmitting system can be cut off.

An exhaust gas from the engine (not shown) is discharged into the hollow la in the propelling machine body 1. The exhaust gas is discharged through the exhaust gas outlets 13 of the bearing holder 10 into the cylindrical portion 31 of the boss body 17 and diverted therefrom into the three exhaust passages 30 to flow sequentially through the exhaust bore 30*a* in the retaining plate 37, the synchronizing chamber 40 and the exhaust bores 30*b* in the mounting plate 46, i.e., the exhaust gas is discharged through the diffuser pipe 39 into the water. The delivery of the exhaust gas from the machine body 1 to the three exhaust passages 30 in the boss body 17 is conducted within the cylindrical portion 31 at the front end of the boss body 17, as described above, and therefore, notwithstanding the propeller boss 12 is in rotation, the exhaust gas can be equally distributed into the three exhaust passages 30.

Moreover, each of the exhaust passages 30 is formed to extend through the land portion 27 of the boss body 17, i.e., through between three recesses 26 which accommodate the bosses 32*a* of the main blades 32M. Therefore, a sufficient sectional area of each exhaust passage 30 can be insured without being obstructed by the corresponding boss 32*a* and the corresponding blade shaft 33 supporting the boss 32*a* and moreover without an increase in diameter of the propeller boss 12. This can contribute to a reduction in the exhaust gas resistance in cooperation with the equal distribution of the exhaust gas.

Each of the blade shafts 33 can be supported at its opposite ends in the pair of front and rear bearing bores 28 and 29 without being obstructed by the adjacent exhaust passage 30 to firmly support the corresponding blade 32M.

In the synchronizer 41, as described above, each of the crank arms 42*a* is bent from the rear end of the blades shaft 33 toward the propeller shaft 4 and received in the relief recess 44 in the outer periphery of the positioning boss 17*a* of the propeller boss 12, and the common synchronizing ring 43 is engaged with the crank pins 42*b*. Therefore, it is possible to achieve a reduction in diameter of the synchronizing ring 43 and a downsizing of the entire synchronizer 41 and thus, the synchronizer 41 can easily be accommodated in the narrow synchronizing chaser 40 in the diffuser pipe 39.

Further, since the common return spring 49 for biasing the synchronizing ring 43 in the direction to close all the main blades 32H is accommodated in the synchronizing chamber 40 to surround the crank arms 42*b*, the single return spring 49 need only be required for all the main blades 32H and moreover, the return spring 49 is protected along with the synchronizer 41 from an abstract.

Figure 11:
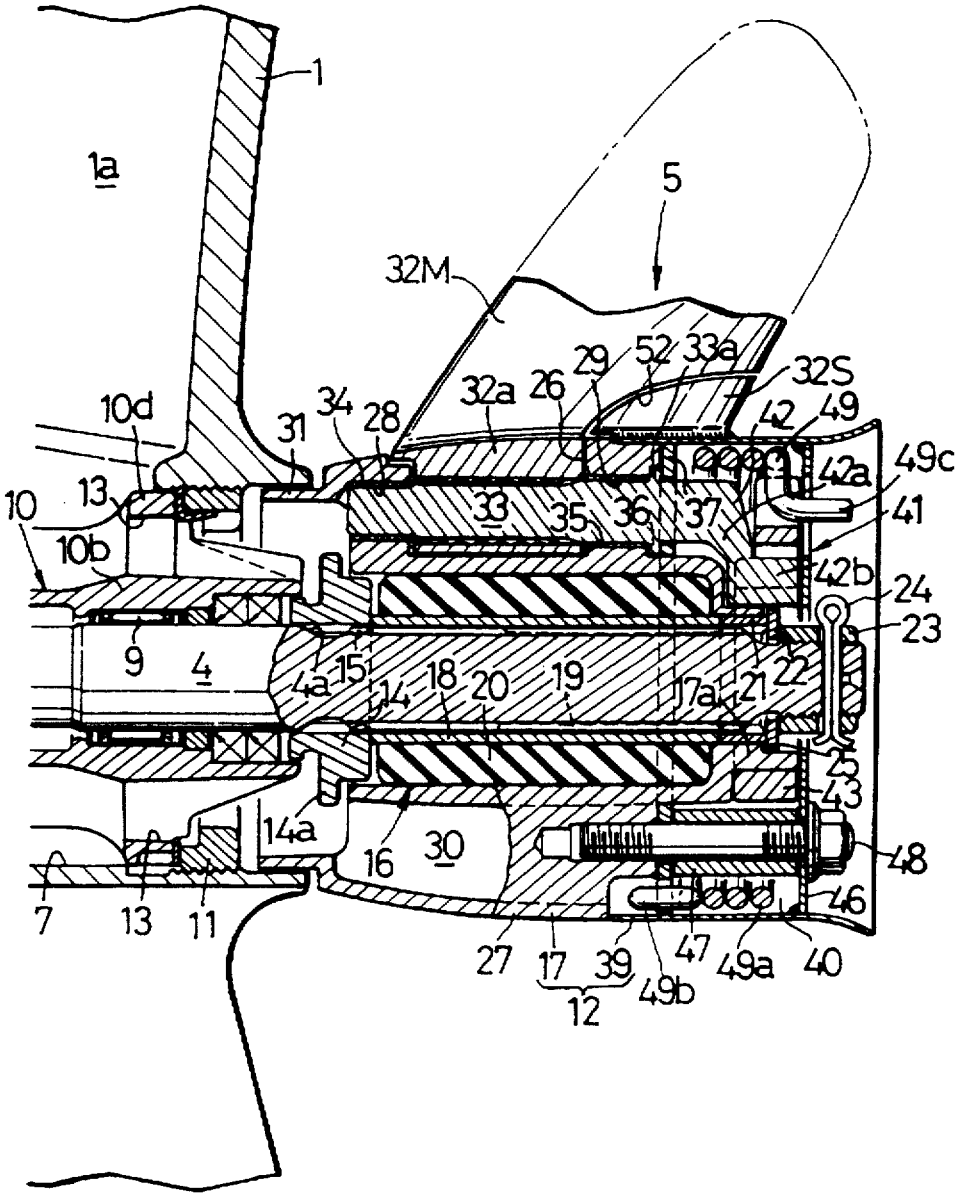
FIG. 11 is a sectional view similar to FIG. 2, but illustrating a second embodiment of the present invention.
Figure 12:
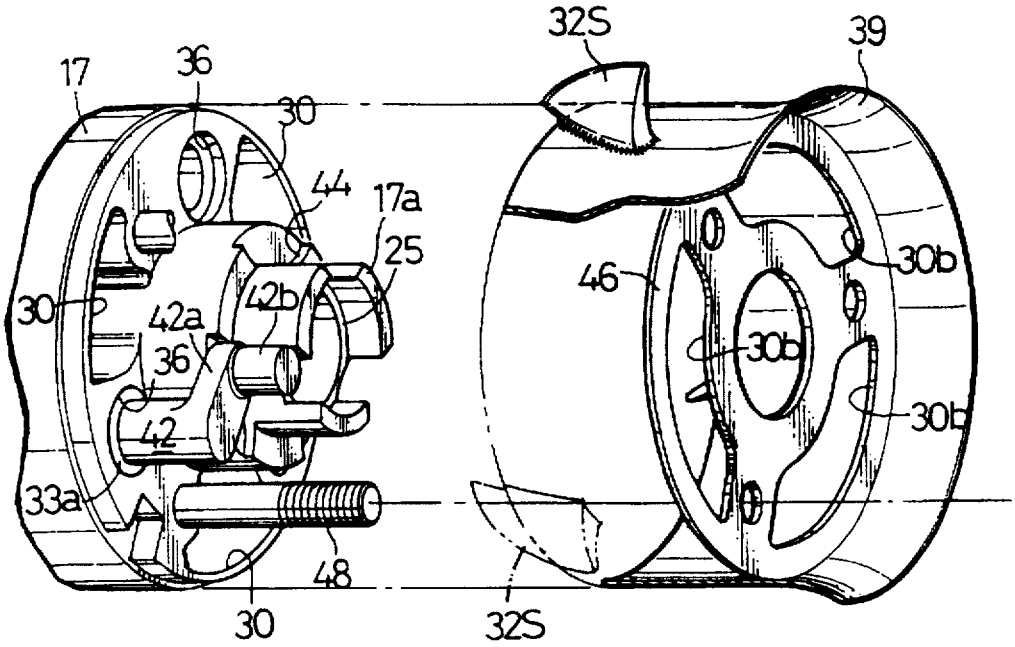
FIG. 12 is an exploded perspective view of an essential portion shown in FIG. 11.

FIGS. 11 and 12 show a second embodiment of the present invention. The second embodiment is similar in construction to the previous embodiment, except that subsidiary blades 32S are fixedly mounted to the outer periphery of the diffuser pipe 39. In FIGS. 11 and 12, portions or components corresponding to those in the previous embodiment are designated by like reference characters.

Although the embodiments of the present invention have been described in detail, it will be understood that the present invention is not limited to the above-described embodiments, and various modifications in design may be made without departing from the spirit and scope of the invention defined in claims.

For example, the shape of the blade area of each of the blades 32M and 32S may be set as desired, depending upon the serious consideration of the low-speed driving property or the high-speed and high-output performance.

What is claimed is:

1. A variable propeller for a boat, comprising:

a propeller boss connected to a propeller shaft;

a main blade pivotally carried on said propeller boss through a blade shaft for opening and closing movements to increase and decrease a propeller diameter; and a subsidiary blade which is fixedly mounted on said propeller boss and arranged abreast with said main blade such that said subsidiary blade is axially superposed on said main blade when said main blade is in a closed state in which the propeller diameter assumes a minimum value, and blade surfaces of said main and subsidiary blade are substantially in line with each other when said main blade is in an opened state in which the propeller diameter assumes a maximum value.

2. A variable propeller for a boat according to claim 1, wherein said subsidiary blade is provided just behind said main blade, and a thickness of said subsidiary blade is set smaller than that of said main blade.

3. A variable propeller for a boat according to claim 1, wherein said propeller boss comprises a boss body connected to said propeller shaft, and a diffuser pipe secured to a rear end of said boss body, and said main blade is pivotally supported on said boss body for opening and closing, and said subsidiary blade is fixedly mounted on said diffuser pipe.

4. A variable propeller for a boat according to claim 1, further including a plurality of blade shafts which are disposed at circumferentially equal distances on the propeller boss for supporting a plurality of said main blades, and a plurality of exhaust passages provided in said propeller boss and extending through between said blade shafts to permit a communication between longitudinally opposite ends of said propeller boss.

5. A variable propeller for a boat according to claim 1, further including a plurality of blade shafts which are rotatably carried on said propeller boss and coupled to bosses of a plurality of said main blades, respectively, each of said main blades being formed such that it undergoes a centrifugal force in its opening direction, a synchronizer accommodated within said propeller boss for connecting said plurality of blade shafts for synchronous rotation, and a return spring also accommodated within said propeller boss for biasing said main blades in their closing directions through said synchronizer.

6. A variable propeller for a boat according to claim 5, wherein said synchronizer comprises cranks connected to one ends of said blade shafts, and a synchronizing ring which is rotatably carried on said propeller boss for rotating movement about an axis of the propeller boss and which is connected to crank pins of said cranks.

7. A variable propeller for a boat according to claim 6, wherein said return spring is mounted between said synchronizing ring and said propeller boss for biasing said synchronizing ring in the direction to close said main blades.

* * * * *